United States Patent [19]

Balhorn

[11] Patent Number: 4,897,969

[45] Date of Patent: Feb. 6, 1990

[54] METHOD AND MEANS FOR TEXTURIZING OBJECTS

[75] Inventor: Milo G. Balhorn, Waterloo, Iowa

[73] Assignee: Masonry Processes, Inc., Atlanta, Ga.

[21] Appl. No.: 189,107

[22] Filed: May 2, 1988

[51] Int. Cl.[4] ..... B24C 3/12

[52] U.S. Cl. ..... 51/418; 51/310

[58] Field of Search ..... 51/417–420, 51/410–411, 413, 414, 426, 310–312, 319, 424, 428; 118/504, 301

[56] References Cited

U.S. PATENT DOCUMENTS

| | | | |
|---|---|---|---|
| 843,082 | 2/1907 | Gale | 51/414 |
| 1,627,096 | 5/1927 | Jones et al. | 51/418 |
| 2,345,648 | 4/1944 | Wolfskill | 51/413 |
| 3,048,146 | 8/1962 | Coppola | 118/504 |
| 3,318,281 | 5/1967 | Plegat | 118/301 |

FOREIGN PATENT DOCUMENTS

| | | | |
|---|---|---|---|
| 0127671 | 8/1982 | Japan | 51/312 |
| 1056868 | 3/1986 | Japan | 51/312 |
| 0576874 | 6/1976 | Switzerland | 51/417 |

*Primary Examiner*—Robert Rose
*Attorney, Agent, or Firm*—Zarley McKee, Thomte, Voorhees & Sease

[57] ABSTRACT

The present invention is directed to a sandblasting unit for testurizing objects, and a method of using the unit. The sandblasting unit includes a frame and a housing, with a sandblasting nozzle positioned within the housing. A conveyor belt moves the objects, such as concrete blocks, through the housing for treatment or testurizing by the sandblasting particles. The nozzle emits a spray of sandblasting particles which disperse to cover an enlarged area, with a concentration of particles in a central locale within the coverage area. A protective baffle plate blocks the spray in the central locale so as to eliminate the concentration of spray therein and thereby produce a uniform texturized surface on the object. The baffle plate is adjustably mounted within the housing so that the desired uniformity of texturizing can be achieved. The unit also includes a collection funnel for collecting the used sandblasting particles and vents for suctioning away the waste material sandblasted from the object.

15 Claims, 1 Drawing Sheet

METHOD AND MEANS FOR TEXTURIZING OBJECTS

BACKGROUND OF THE INVENTION

The surface of concrete blocks and the like are often texturized by sandblasting so as to improve or achieve a desired appearance. However, with conventional sandblasting equipment, the spray of particles from the sandblasting nozzle tends to concentrate the particles in a central locale. The concentration of particles results in a non-uniform treatment or texturizing of the block or object. Because of this non-uniformity, sandblasting of such surfaces has been restricted to manual operations where the operator blasts each unit individually, visually inspects the unit, and subjects the unit to additional blasting to attain a uniform appearance. This manual procedure is time-consuming, subject to error, and therefore relatively expensive.

Therefore, it is a primary objective of the present invention to provide an improved method and means for texturizing concrete blocks and other objects.

Another objective of the present invention is the provision of production line-type operation for quickly and uniformly texturizing objects at a low cost.

A further objective of the present invention is the provision of a method of sandblasting concrete blocks and other objects wherein the concentrated central locale area of the sandblasting spray is blocked so as to eliminate the concentration of sandblasting particles and thereby produce a uniform texturized surface.

Another objective of the present invention is the provision of a sandblasting unit having at least one baffle to block the concentration of sandblasting particles in the central locale of the spray coverage area, so as to produce a uniform surface.

A further objective of the present invention is the provision of a spray nozzle and blocking baffles which are adjustable with respect to one another so as to achieve the desired extent of blocking of the concentrated sandblasting particles and thereby produce the desired uniformity of texturizing.

These and other objectives will become apparent from the following description of the present invention.

DETAILED DESCRIPTION OF THE DRAWINGS

Figure 1:
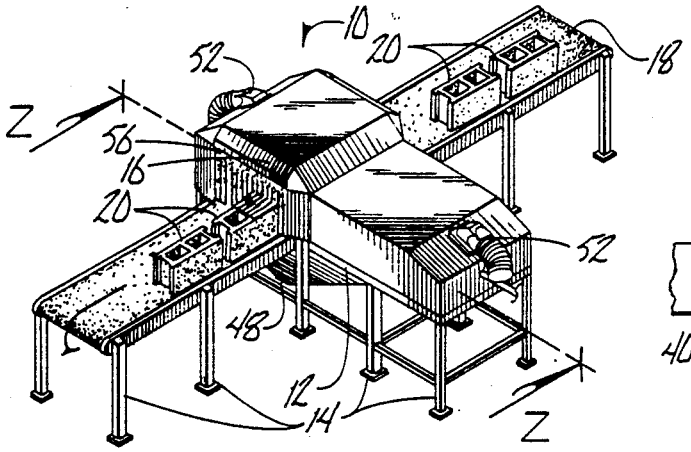
FIG. 1 is a perspective view of the sandblasting unit of the present invention.

In the drawings, the reference numeral 10 generally designates the sandblasting unit of the present invention. Unit 10 includes a frame 12 with a plurality of legs 14. A housing 16 is mounted on the frame. A conveyor 18 is operatively mounted on frame 12 and extends through housing 16. Concrete blocks 20 or other objects to be sandblasted sit upon conveyor 18 for movement through housing 16.

Figure 2:
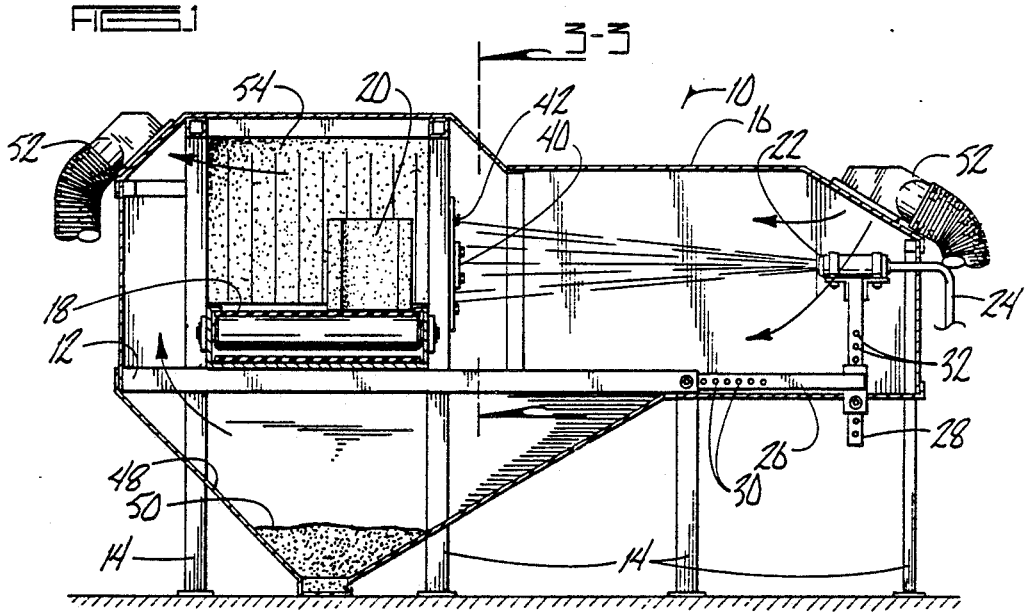
FIG. 2 is a sectional view taken along lines 2—2 of FIG. 1.

A conventional sandblasting spray nozzle 22 is mounted within housing 16, as best seen in FIG. 2.

Nozzle 22 is operatively connected to a source of sandblasting material via an inlet line 24. Nozzle 22 is adjustably mounted to frame 12 by any conventional means. One example is shown in the drawings, wherein a horizontal arm 26 and a vertical arm 28, each of which have a plurality of openings 30, 32 respectively, which allow for horizontal and vertical positioning of nozzle 22 with respect to block 20.

Figure 4:
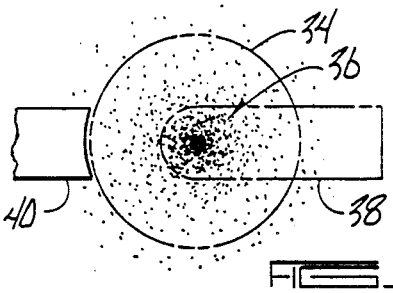
FIG. 4 is an enlarged schematic illustrating the concentration of sandblasting particles within the sandblasting coverage area.

Nozzle 22 emits an adjustable spray of sandblasting particles which diverge to cover a generally circular area 34, as indicated in FIG. 4. The sandblasting particles tend to be concentrated in a central locale 36 within coverage area 34. Such concentration of particles in the central locale produces a non-uniform texturized surface in conventional sandblasting units.

To overcome the non-uniformity of surface texturizing produced by the concentration of particles in the central locale, the present invention utilizes a baffle plate 38 for blocking the central locale and thereby producing a uniform texture on the surface of the concrete block or object. The shape of baffle plate 38 may be varied to achieve different texturizing effects. A second baffle plate 40 is also preferably utilized, but may not be necessary in all instances, depending on the sandblasting spray characteristics.

Plates 38 and 40 are mounted by any conventional manner within housing 16 between nozzle 22 and block 20. As shown in the drawings, baffle plates 38 and 40 are mounted on mounting plates 42 which in turn are mounted on frame 12. As seen in FIG. 4, mounting plates 42 include vertically disposed slots 44 to allow vertical adjustment of the baffle plates. Similarly, baffle plates 38 and 40 include horizontal slots 46 which allow horizontal adjustment of the baffle plates. Thus, baffle plate 38 can be adjustably mounted within housing 16 to block out the concentrated spray of particles within central locale 36, and thereby eliminate non-uniform texturizing of the surface of the block or object. Similarly, baffle plate 40 can be adjustably mounted to protect the surface of the block or object from excessive sandblasting. Baffle plates 38 and 40 are spaced closely to the surface of the block so that the effect of deflection of the plates upon impact by the sandblasting particles is eliminated or minimized.

Figure 3:
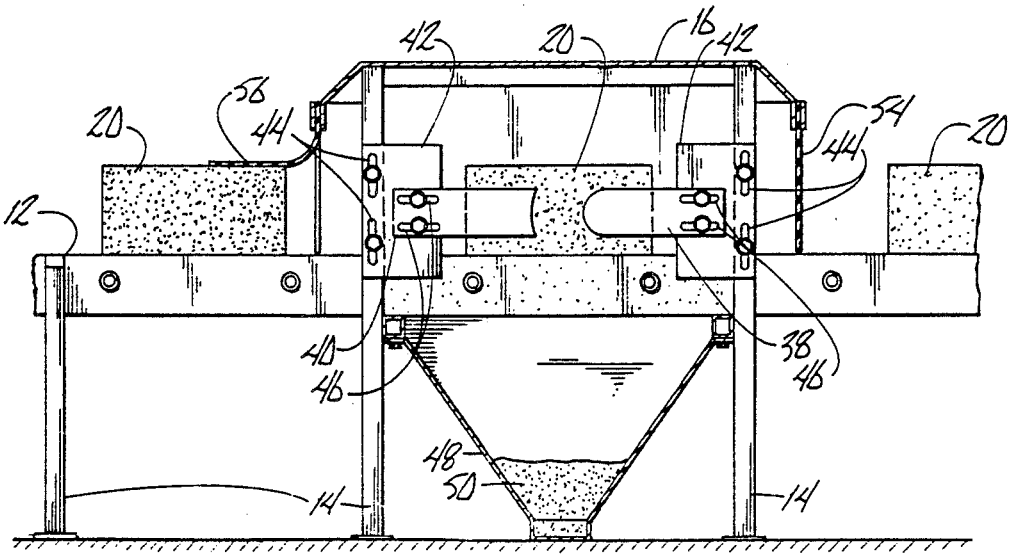
FIG. 3 is a sectional view taken along lines 3—3 of FIG. 2.

Preferably, baffle plates 38 and 40 are made of a rubber material so as to absorb the impact of the sandblasting particles. This material must be sufficiently strong so as to maintain the substantial position shown in FIG. 3 and so as to substantially avoid deflection toward block 20 during the sandblasting process. As an alternative, baffle plates can be constructed of a rigid substrate, such as metal, covered with an energy absorbing material, such as rubber. Also, the use of rubber or the like minimizes the sound intensity of the unit during the sandblasting process.

The sandblasting unit 10 also includes a collection trough 48 for collecting the used sandblasting particles 50. Particles 50 can then be filtered and recirculated for further emission from nozzle 22. Vents 52 are also provided on unit 10, as best seen in FIG. 2, for suctioning away the waste material blasted from the concrete blocks or objects. Housing 16 includes an inlet covered by a plurality of membrane strips 54 and an outlet covered by membrane strips 56 which allow the passage of blocks 20 to and from the interior of unit 10. Other convenient means for sealing the inlet and outlet may be provided. Also, frame 12 may be covered with an energy absorbing material, such as rubber, within the housing 16 so as to minimize deflection of the sandblasting particles.

In operation, the block or object to be treated or texturized is placed on conveyor 18 which moves the object through inlet door 54 into the interior chamber defined by housing 16. A power source is actuated so that sandblasting particles are emitted from nozzle 22. Nozzle 22 sprays the particles so that they cover a somewhat circular area 34 with a concentration of articles in a central locale 36, as depicted in FIG. 4. Baffle plate 38 blocks this concentration of particles within the central locale so that the surface of the object is protected from the impact of these concentrated particles. As the block or object moves through housing 16 and past baffle plate 38, the remaining disbursed sandblasting particles impact the surface of the block or object so as to produce a uniform texturized surface. Baffle plate 40 further protects a central area of the object from excessive treatment or texturizing as the block continues through housing 16. The used sandblasting particles 50 fall by gravity into collection trough 48 and can then be filtered and recirculated to nozzle 22 for reuse.

From the foregoing, it can be seen that at least all of the stated objectives are accomplished by the present invention.

What is claimed is:

1. A method of texturizing an object, comprising:

moving the object through a housing having a sandblasting nozzle mounted therein;

subjecting a surface of the object to a spray of particles from the nozzle so as to texturize the surface of the object, the spray having an area of coverage and being concentrated in a central locale within the coverage area; and blocking the spray in the central locale with blocking means located between the nozzle and the object so as to eliminate the concentration of spray therein allowing only a peripheral portion of the spray to reach the surface of said object and thereby produce uniform texturizing of said surfaces.

2. The method of claim 1 wherein the method further comprising adjusting the position of the blocking means with respect to the spray so as to achieve a desired extent of blocking and thereby uniformity of texturizing.

3. The method of claim 2 wherein the surface is exposed to portions of the spray outside the central locale as the object moves through said housing and past the blocking means.

4. The method of claim 1 further comprising adjusting the position of the nozzle with respect to the object.

5. The method of claim 1 further comprising adjusting the intensity of the spray.

6. A sandblasting unit for texturizing a surface of an object comprising:

a frame;

a housing mounted on the frame;

a nozzle mounted within the housing and being operatively connected to a source of sandblasting particles, the nozzle being adapted to emit a spray of sandblasting particles, the spray having an area of coverage and being concentrated in a central locale within the coverage area;

means for moving the object through the housing and thereby exposing the surface of the object to the spray; and means located between the nozzle and the object for blocking the spray in the central locale so as to eliminate the concentration of spray therein allowing only a peripheral portion of the spray to reach the surface of said object and thereby produce uniform texturizing of the surface of the object said blocking means comprising an elongated member extending into said housing and having an imperforate exposed end and a longitudinal axis of symmetry which intersects the central locale.

7. The unit of claim 6 wherein the means for blocking the central locale of the spray is a first baffle plate mounted within the housing.

8. The unit of claim 7 wherein the baffle plate is adjustably mounted to the frame for vertical and horizontal movement.

9. The unit of claim 7 wherein the baffle plate is made of an energy absorbing material for absorbing the impact of the sandblasting particles.

10. The unit of claim 7 further comprising a second baffle plate spaced apart from the first baffle plate so as to protect at least a portion of the surface of the object from excessive spray.

11. The unit of claim 10 wherein the second baffle plate is adjustably mounted on the frame for vertical and horizontal movement.

12. The unit of claim 6 wherein the nozzle is adjustably mounted on the frame for movement toward and away from the object.

13. The unit of claim 6 wherein the nozzle is adjustably mounted on the frame for vertical movement.

14. The unit of claim 6 wherein the means for moving the object through the housing is a conveyor.

15. The unit of claim 6 further comprising a collection trough for collecting the used sandblasting particles.

* * * * *